United States Patent [19]

DeVita et al.

[11] 4,401,279

[45] Aug. 30, 1983

[54] SYNCHRONOUSLY COUNTER-ROTATING INTERMESHING DIFFERENTIAL SPEED CRUSHER ROLL ASSEMBLY

[75] Inventors: Achilles P. DeVita, Hallandale; Manley C. Watkins, Titusville, both of Fla.

[73] Assignee: General Steel Industries, Inc., St. Louis, Mo.

[21] Appl. No.: 296,897

[22] Filed: Aug. 27, 1981

[51] Int. Cl.[3] ..... B02C 18/18

[52] U.S. Cl. ..... 241/236

[58] Field of Search ..... 241/236

[56] References Cited

U.S. PATENT DOCUMENTS

| | | | |
|---|---|---|---|
| 203,364 | 5/1878 | Newell | 241/236 |
| 1,671,868 | 5/1928 | McGougan et al. | 241/236 X |
| 2,150,278 | 3/1939 | Hegenbarth | 241/236 X |
| 2,219,077 | 10/1940 | Pharo | 241/236 X |
| 3,240,436 | 3/1966 | Mylting | 241/236 X |
| 3,664,592 | 5/1972 | Schweigert et al. | 241/236 UX |
| 4,260,115 | 4/1981 | Hatanaka | 241/236 |

FOREIGN PATENT DOCUMENTS

| | | | |
|---|---|---|---|
| 2831953 | 12/1979 | Fed. Rep. of Germany | 241/236 |
| 552881 | 12/1956 | Italy | 241/236 |
| 56627 | 6/1944 | Netherlands | 241/236 |

*Primary Examiner*—Howard N. Goldberg
*Attorney, Agent, or Firm*—Learman & McCulloch

[57] ABSTRACT

A pair of counter-rotating crusher rolls are provided with intermeshing teeth having configurations especially adapted to accept and positively feed relatively large lumps or portions to be crushed into the nip of the rolls and to crush the fed material into particles of a relatively small size.

6 Claims, 8 Drawing Figures

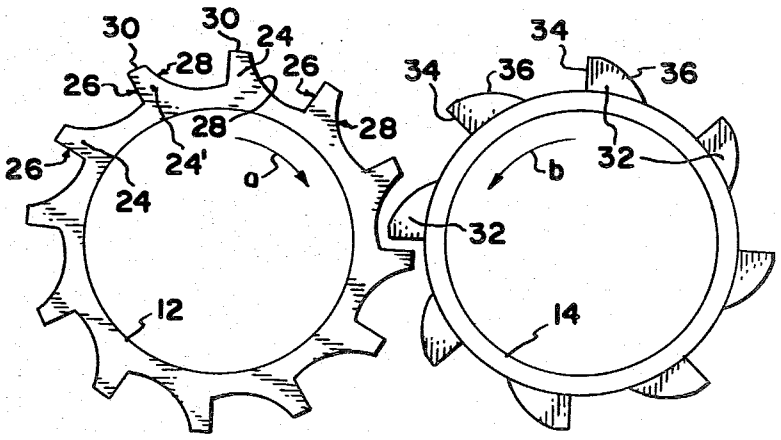
FIG.2
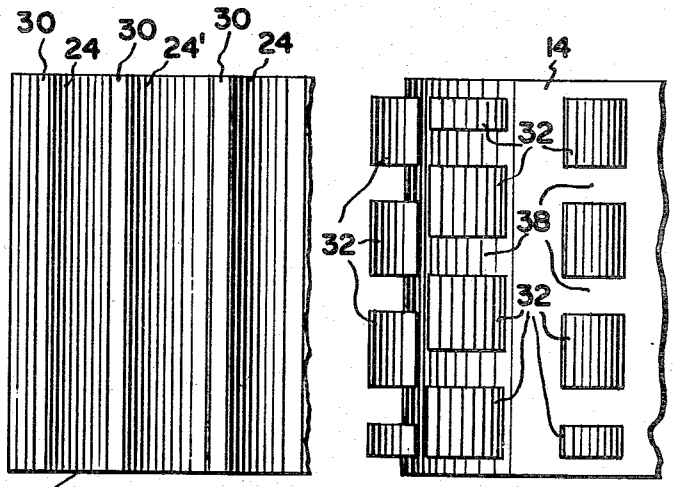
FIG.4
FIG.3
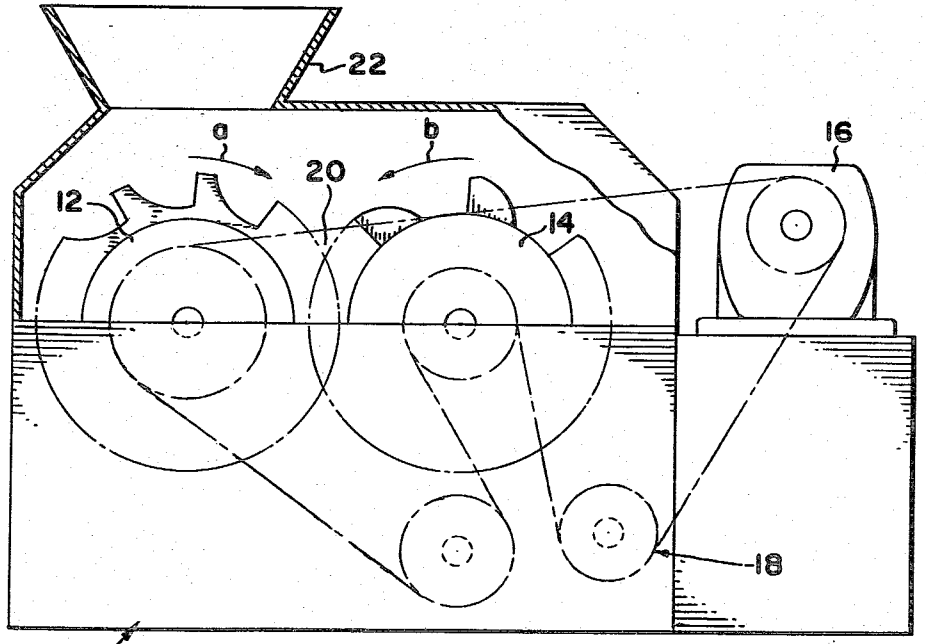
FIG.1

SYNCHRONOUSLY COUNTER-ROTATING INTERMESHING DIFFERENTIAL SPEED CRUSHER ROLL ASSEMBLY

BACKGROUND OF THE INVENTION

The present invention is especially directed to crushing apparatus in which material to be crushed is fed into the nip between the teeth of a pair of power-driven, counter-rotating rolls driven at different speeds to be crushed into relatively fine particles. In the usual case, the rolls are provided with somewhat intermeshing teeth which must act to drive incoming lumps into the nip. The teeth are so designed that the teeth on one roll do not contact the teeth on the other, but, as the teeth pass through the nip between the rolls, they approach their minimum spacing from each other, and it is this minimum spacing which defines the maximum size of particles which are crushed by their passage through the nip. U.S. Pat. Nos. which disclose such crushers are: 48,244, 842,681, 1,435,330, 1,750,941, 1,824,088, 2,578,540, 2,588,900, 3,208,677, 3,240,436, 3,474,973.

A typical operation employing crusher roll pairs of the type referred to above is found in foundries where used sand cores employed in the casting operations are crushed in order to salvage the sand for use in making up new cores.

Most presently available crusher rolls employed in operations of the type described above are found wanting from the standpoint of the range of reduction in size which they can achieve. Those roll pairs which will accept and positively feed relatively large lumps into the crushing nip will discharge relatively large sized crushed particles which are too large for their intended use, while those roll pairs which will crush particles to the desired degree of fineness will not adequately feed relatively large lumps. In the previously mentioned example of crushing foundry sand cores, the cores or parts thereof recovered are frequently of relatively large over-all dimension as compared to the size of the sand particle desired, and most core crushing operations require passage of the material through two or three or more successively finer pairs of crushing rolls before particles of the desired degree of fineness are obtained.

It is the purpose of the present invention to provide a tooth configuration for crushing rolls of the type described above which will accept material of relatively large over-all dimension and crush the material into relatively small particles so that objects, such as foundry sand cores, can be reduced to particles of the desired fineness in a single crushing operation. Whereas previous machinery has normally accomplished 6:1 reduction, the present construction is designed to greatly exceed this.

SUMMARY OF THE INVENTION

In accordance with the present invention, a first or anvil roll is constructed with teeth having flat trailing edges lying in respective radial planes substantially intersecting the axis of rotation of the roll. The leading edge of the teeth on the anvil roll are concavely curved.

A mating crusher roll is provided with teeth of a shape complementary to those of the anvil roll—that is the crusher roll teeth have a flat leading edge lying in a plane radial to the axis of the crusher roll and are formed with a convexly curved trailing edge generally complementary to that of the concavely curved leading edges of the anvil roll teeth.

The axes of rotation of the two rolls are so spaced that the paths of the teeth of the respective rolls overlap, but the teeth on the respective counter-rotating rolls do not come in contact with each other. The toothed configuration described provides, just above the nip between the rolls, a relatively wide upwardly opening pocket, while the flat edges on the teeth of the respective rolls move into a closely spaced parallel relationship with each other as the teeth pass downwardly through the horizontal plane containing the axes of rotation of the two rolls.

Further objects and features of the invention will become apparent by reference to the drawings and to the following specification.

IN THE DRAWINGS

FIG. 1 is a schematic side elevational view, partially in cross section, of a crusher roll assembly embodying the present invention;

FIG. 2 is a detail side elevational view showing the intermeshing teeth of the anvil and crusher rolls of the apparatus of FIG. 1;

FIG. 3 is a top plan view of the anvil roll;

FIG. 4 is a top plan view of the crusher roll; and

Figures 5, 6, 7, 8:
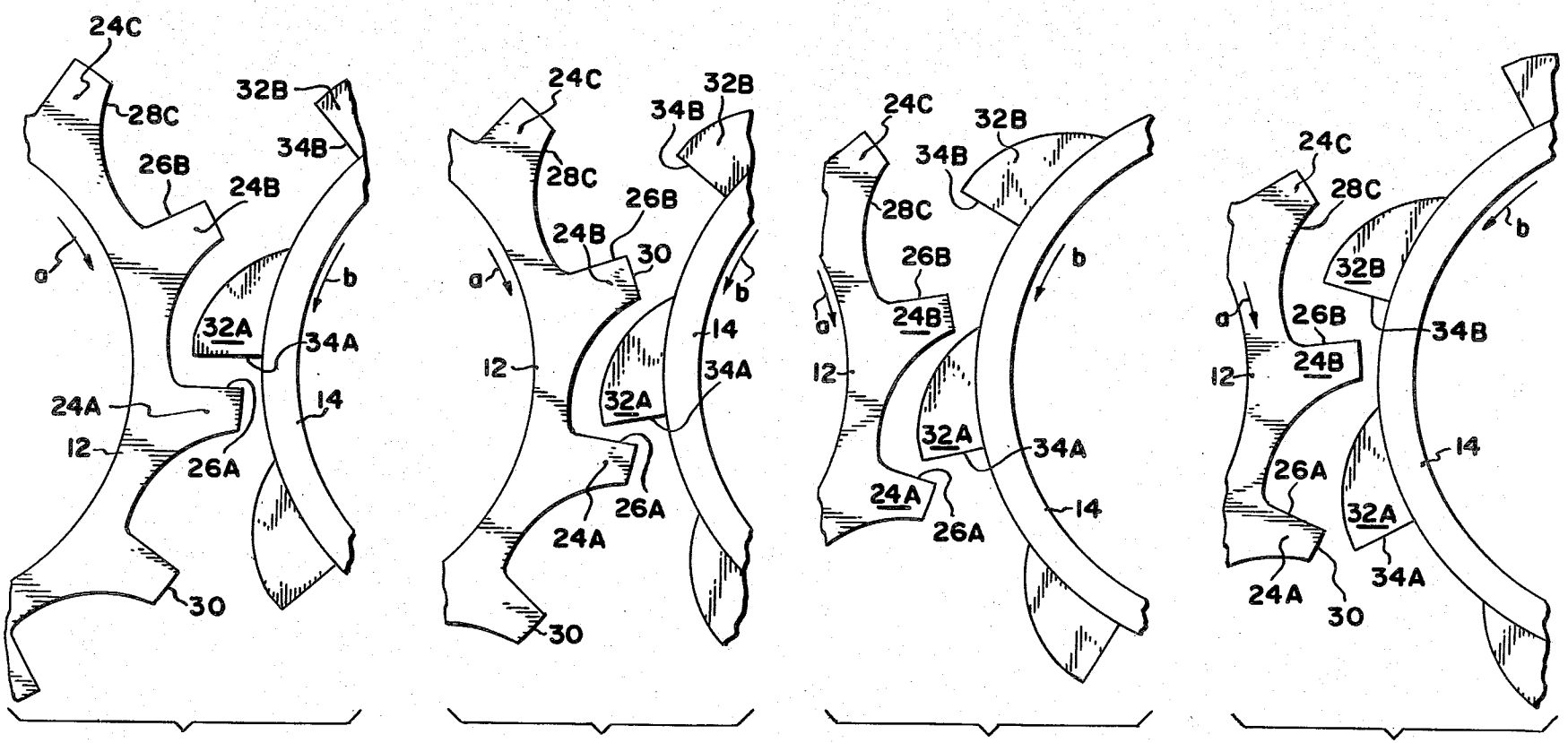
FIGS. 5, 6, 7 and 8 are sequential views showing the relationship between the teeth on the respective rolls as they pass through the nip.

Referring first to FIG. 1, an apparatus embodying the present invention includes a frame or housing designated generally 10 within which an anvil roll 12 and a crusher roll 14 are mounted for rotation about spaced parallel horizontal axes. A drive motor 16, mounted upon frame 10, is operable to drive rolls 12 and 14 in counter-rotation at predetermined different speeds of rotation, as by means of a chain and sprocket drive designated generally 18. As indicated, rolls 12 and 14 are driven in opposite direction of rotation so that the teeth on the exterior of the respective rolls move downwardly through the nip 20 between the rolls. Material to be crushed by the counter-rotating rolls 12 and 14 is fed into the nip via a hopper 22, is carried downwardly by the teeth on rolls 12 and 14 through the nip 20, the material being fully crushed during its passage through the nip.

The present improvement is directed to the configuration of the teeth on the rolls 12 and 14. This configuration, as will be developed below, is especially well adapted to receive relatively large sized lumps of material from hopper 22, to positively feed these relatively large lumps downwardly into the nip 20, and to crush them into relatively small sized particles. The configuration of the teeth on rolls 12 and 14 is best seen in FIGS. 2, and 5–8.

Referring to FIG. 2, it is seen that the teeth 24 on anvil roll 12 are formed with a flat trailing edge 26 (the designation "trailing" being with respect to the direction of rotation of roll 12 indicated by arrow a). The flat surface of trailing edge 26 lies in a general plane which is substantially radial to the axis of anvil roll 12. The leading edge 28 of tooth 24 is concavely curved and is preferably of a substantially constant radius of curvature. A peripheral tip surface 30 lying at a constant radius from the axis of roll 12 extends between the leading and trailing edges of each tooth 24, 24', etc. of anvil roll 12.

The teeth 32 of crusher roll 14 which is driven in the direction identified by arrow b are generally complementary in shape to the teeth of anvil roll 12. The leading edge 34 of each crusher roll tooth 32 is flat and lies in a general plane substantially radial to the axis of crusher roll 14, while the trailing edge 36 of crusher roll tooth 32 is convexly curved at substantially a constant radius of curvature which is slightly less than the radius of curvature of the concavely curved leading surfaces 28 of anvil roll teeth 24.

From FIG. 2, it will be noted that although the diameter of the rolls 12 and 14 is the same, the number of teeth on each roll differs. In the embodiment shown in the drawings, anvil roll 12 has twelve teeth 24, while crusher roll 14 has eight teeth. The respective rolls are synchronously driven at different speeds of rotation so that the same intermeshing relationship between the teeth is maintained—that is the product of the number of teeth upon a roll and its rate of rotation is the same for both rolls. This arrangement assures that a given tooth on one roll is matched with different teeth on the other roll during successive revolutions and promotes even wearing of the teeth.

FIGS. 5, 6, 7, and 8 show successive steps in the rotation of the rolls 12 and 14 to illustrate the crushing action exerted by the teeth.

Referring first to FIG. 5, in this view, tooth 24A on anvil roll 12 has its trailing surface 26A disposed in spaced opposed parallel relationship to the leading edge 34A of tooth 32A on crusher roll 14. The spacing indicated between edges 26A and 34A in FIG. 5 represents essentially the maximum particle dimension of material crushed between the two rolls, the crushing action exerted upon material caught between the teeth of the two rolls being performed substantially entirely by the movement of the flat leading edge 34A of the tooth 32A toward the flat trailing edge 26A of the opposed tooth.

At the same time, it will be noted that there is a substantial spacing between the leading edge 34B of the next trailing tooth 32B on crusher roll 14, and the pocket on the anvil roll 12 defined by the trailing edge 26B of the next trailing tooth 24B on anvil roll 12 and the leading edge 28C of the next trailing tooth 24C. This particular space is relatively large, and lumps to be crushed which are fed from hopper 22 (FIG. 1) and can be received within this space will be subjected to a crushing action as the respective rolls 12 and 14 are counter-rotated from the FIG. 5 position.

Referring now to FIG. 6, both rolls have been advanced slightly from the position shown in FIG. 5, the flat tooth surfaces 26A and 34A having now passed below the horizontal so that the tip of tooth 32A has started to scrape crushed particles outwardly off the surface 26A of tooth 24A. In FIG. 6, the leading edge 34B of tooth 32B has moved further toward the horizontal from the FIG. 5 position, and any large pieces of material captured underneath this surface are now being pressed toward the pocket defined by surfaces 26B and 28C on anvil roll 12.

Referring now to FIG. 7, tooth 32A has now substantially cleared tooth 24A, while tooth 32B is now moving into a relationship with anvil roll 12 such that surface 34B of tooth 32B is substantially closing the space at which material enters the nip between the two rolls to trap incoming objects or lumps underneath surface 34B. Further rotation of the two rolls brings the teeth 24B and 32B into the relationship shown in FiG. 8 in which a substantially closed chamber is now created between teeth 32B and 24B. Further rotation of the respective rolls brings the surfaces 34B and 26B into the same relationship as the corresponding surfaces 34A and 26A illustrated in FIG. 5, this last transition crushing the material trapped under surface 34B which, because of the greater speed of rotation of crusher roll 14 as compared to that of anvil roll 12, simply reduces the volume of the "chamber" between the opposed flat surfaces as they move from their relationship shown in FIG. 8 to that shown in FIG. 5.

One form of tooth arrangement is shown in FIGS. 3 and 4. As illustrated in these two figures, the teeth 24 on anvil roll 12 are continuous over the entire axial length of the roll, while the teeth 32 on crusher roll 14 are disposed in axially aligned rows with spaces 38 between adjacent teeth within each axial roll. The teeth in adjacent rolls are staggered with respect to each other so that a space 38 between two adjacent teeth in one axial row is aligned with a tooth 32 in the next adjacent row. This arrangement of teeth permits excess material which may have been trapped within the "chamber" as shown between surfaces 34B and 26B in FIG. 8 to be expressed axially of tooth 32B into the spaces 38 at opposite sides of the tooth as this "chamber" is reduced in volume during the crushing operation. Without this relief, it is possible that an excess of quantity of material might be trapped between the teeth to jam or stall the drive.

While one embodiment of the invention is described in detail above, it will be apparent to those skilled in the art that the disclosed embodiment may be modified. Therefore, the foregoing description is to be considered exemplary rather than limiting, and the true scope of the invention is that defined in the following claims.

We claim:

1. In a crusher roll assembly having radially intermeshing, first and second toothed crusher rolls, with a nip between them, mounted for, and driven in, coordinated counterrotation about spaced parallel axes to crush material fed into the nip between the rolls; the number of teeth on said second roll being less than the number of teeth on said first roll; and means for driving said second roll at a higher rate of rotation than said first roll; the improvement wherein the leading edge of each tooth on said first roll is a concavely curved surface and the trailing edge of each tooth on said first roll is a substantially flat surface substantially radial to the axis of said first roll, said leading and trailing tooth edges on the first roll being connected by lands; each tooth on said second roll having a leading edge surface defined by a substantially flat surface and a convexly curved trailing edge surface generally complementary in shape to the leading edge surface of a tooth on said first roll; the teeth on the second roll being connected by roots which intermesh with said lands on the first roll; the teeth on the first and second rolls being radially opposite and the axes of rotation of said rolls being spaced from each other by a distance such that the teeth on the respective rolls move in overlapping paths through the nip between the rolls with the teeth on the respective rolls maintained in spaced relationship to each other; the tooth spacing on said respective rolls being such that counterrotation of said rolls advances the substantially flat leading edge surface of a first tooth on the second roll toward the concave trailing edge surface of a first tooth on the first roll, while disposing the trailing convex edge surface of a second tooth on the second roll which is immediately downstream from said first tooth on the second roll generally opposite the leading concave edge surface of a second tooth on the first roll which is immediately downstream of said first tooth on the first roll, the substantially flat leading edge surface of the second tooth on the second roll at this time being generally opposite and generally parallel to the substantially flat trailing edge of still a third tooth on the first roll which is immediately downstream of said second tooth on the first roll.

2. The invention defined in claim 1 wherein the teeth on said first roll extend continuously substantially the entire axial extent of said first roll, the teeth on said second roll being disposed in intermittant spaced relationship to each other in axially aligned rows.

3. The invention defined in either of claims 1 or 2 wherein the flat leading edges of the teeth on said second roll lie in respective general planes extending substantially radially of the axis of said second roll.

4. The invention defined in claim 2 wherein the teeth in one of said axially aligned rows are axially offset from the teeth in an adjacent axially aligned row.

5. The invention defined in claim 1 wherein drive means coupled to both of said rolls drives the respective rolls at respective speeds inversely proportional to the number of teeth on the roll.

6. The assembly of claim 1 in which the generally parallel condition of said flat leading and flat trailing edge surfaces occurs substantially in a plane connecting the axes of rotation of the rolls.

* * * * *